US010611009B2

(12) United States Patent
Huang et al.

(10) Patent No.: US 10,611,009 B2
(45) Date of Patent: Apr. 7, 2020

(54) NAIL GUN STRUCTURE

(71) Applicant: EVERWIN PNEUMATIC CORPORATION, Taichung (TW)

(72) Inventors: Wen Sheng Huang, Taichung (TW); Wei-Jen Chen, Taichung (TW)

(73) Assignee: EVERWIN PNEUMATIC CORPORATION, Taichung (TW)

( * ) Notice: Subject to any disclaimer, the term of this patent is extended or adjusted under 35 U.S.C. 154(b) by 399 days.

(21) Appl. No.: 15/621,312

(22) Filed: Jun. 13, 2017

(65) Prior Publication Data

US 2018/0354112 A1 Dec. 13, 2018

(51) Int. Cl.

| | |
|---|---|
| ***B25C 1/00*** | (2006.01) |
| ***B25C 1/04*** | (2006.01) |
| ***B25C 5/13*** | (2006.01) |
| ***B27F 7/09*** | (2006.01) |
| ***B25C 7/00*** | (2006.01) |
| *B27F 7/34* | (2006.01) |

(52) U.S. Cl.

CPC ..... *B25C 1/008* (2013.01); *B25C 1/041* (2013.01); *B25C 1/047* (2013.01); *B25C 5/13* (2013.01); *B25C 7/00* (2013.01); *B27F 7/09* (2013.01); *B27F 7/34* (2013.01)

(58) Field of Classification Search

CPC ..... B25C 1/008; B25C 1/041; B25C 1/047; B25C 7/00; B25C 5/13; B27F 7/09

USPC ..... 227/3, 39, 8, 19, 122

See application file for complete search history.

(56) References Cited

U.S. PATENT DOCUMENTS

| | | | | |
|---|---|---|---|---|
| 3,734,378 | A * | 5/1973 | Rice | B25C 5/0292 227/124 |
| 4,343,831 | A * | 8/1982 | Tsuji | G11B 5/842 427/128 |
| 6,237,827 | B1 * | 5/2001 | Reckelhoff | B25C 5/0292 227/130 |
| 2014/0076954 | A1 * | 3/2014 | Miller | B27M 3/0073 227/155 |
| 2014/0209657 | A1 * | 7/2014 | Huang | B27F 7/09 227/19 |
| 2015/0102086 | A1 * | 4/2015 | McCardle | B25C 7/00 227/155 |

* cited by examiner

*Primary Examiner* — Michelle Lopez
*Assistant Examiner* — Chinyere J Rushing-Tucker
(74) *Attorney, Agent, or Firm* — Muncy, Geissler, Olds & Lowe, P.C.

(57) ABSTRACT

A nail gun structure includes a body portion including a punch portion; an air cylinder between the body portion and a swaying clamp arm, and having a telescopic rod pivotally connected with the clamp arm, the air cylinder having a piston, a first bore and a second bore disposed along an axial direction of the telescopic rod, the piston connected with the telescopic rod and reciprocating to control the communication of the second bore; and a control valve disposed between the air cylinder and the body portion, and having a tube set connected with an air source and also between the air cylinder and the body portion. When the air source and the tube set communicate with the first bore, the piston moves to allow the communication of the second bore. After the clamp arm clamping a wooden board, the punch portion punches to launch the nail.

6 Claims, 7 Drawing Sheets

NAIL GUN STRUCTURE

BACKGROUND OF THE INVENTION

1. Field of the Invention

The present invention relates to tool structures, and more particularly, to a nail gun structure of a nail gun for pallet processing.

2. Description of the Related Art

As shown by Taiwan patent 1440533, a clamp device combined to a nail gun is disclosed, which controls the clamping and releasing timing of the clamp arm and the nail punching timing in an air compressing manner. However, through the controlling method of the nail gun by use of air compression, the controlling valve for adjusting the air pressure might be loosened and cause an error upon the nail punching timing, such that the nail punching timing is not effectively controlled. If the nail punching operation is carried out before the clamp arm stably clamps a target board or a pallet, or if the clamp arm releases the target board or pallet before the nail punching operation is complete, the nail punching may possibly fail. Or, the target board or pallet or the nail gun may be damaged due to the punching fail.

Also, if the air compressions provided for each nail gun or the thicknesses of each target board are different on site, the pressure controlling valve shall be adjusted before the construction work begins, so as to prevent the nail punching effect from being affected due to the air compression variation, thus causing a relatively complicated construction process. Therefore, it is desirable to improve the nail gun motion stability and the complicated construction process.

SUMMARY OF THE INVENTION

For improving the issues above, a nail gun structure is disclosed. When the air source and the tube set communicate with the first bore of the air cylinder, the piston moves and allows the communication of the second bore. When the clamp arm and the punch portion reach the wood board, the second bore and the tube set communicate with the body portion of the nail gun, and the punch portion punches to launch the nail. Therefore, the nail punching motion is assured to be carried out after the clamp stably clamping the wooden board, preventing the body portion and the wooden board from being damaged by the unstable operation.

For achieving the aforementioned objectives, a nail gun structure in accordance with an embodiment of the present invention is provided, comprising:

a body portion including a punch portion, the punch portion punching a nail to launch the nail;

an air cylinder disposed between the body portion and a clamp arm, the air cylinder including a telescopic rod pivotally connected with the clamp arm, the clamp arm pivotally swaying against the punch portion, the air cylinder further including a piston, a first bore, and a second bore, the first bore and the second bore mutually spaced and disposed along an axial direction of the telescopic rod, the piston connected with the telescopic rod and reciprocating along an axial direction of the telescopic rod to control a communication function of the second bore; and a control valve disposed between the air cylinder and the body portion, the control valve including a tube set connected between the air cylinder and the body portion, with an air source connected with the tube set and providing a compressed air to the tube set, wherein when the air source and the tube set communicate with the first bore, the piston moves to allow the communication of the second bore, such that the telescopic rod drives the clamp arm to sway against the punch portion, and when the clamp arm and the punch portion reach a wooden board placed between the clamp arm and the punch portion, the second bore and the tube set are connected with the body portion, and the punch portion punches to launch the nail.

Preferably, the control valve includes a first valve chamber and a second valve chamber that are connected with the air cylinder and the body portion. The tube set includes a first tube, a second tube, a third tube, a fourth tube, and a fifth tube. The first tube and the second tube are connected with the first valve chamber; also, the first tube is connected with the air source. The second tube is connected with the first bore. The third tube and the fourth tube are connected with the second valve chamber. The fourth tube is further connected with the air source. The third tube is connected with the second bore. The fifth tube is connected with the air source, the first valve chamber, and the second valve chamber.

Preferably, the body portion is provided with a connect member connected with the fifth tube and the air source, wherein the connect member is rotatable.

Preferably, the clamp arm includes a connect end and a clamp end disposed in opposite to the connect end. The connect end is connected with the telescopic rod. The clamp end faces the punch portion and is provided with a block member, wherein the block member is combined to the clamp end along a radial direction of the telescopic rod.

With such configuration, by use of the piston moving inside the air cylinder to decide the timing of the nail punching, the nail punching operation is assured to be carried out after the clamp arm clamping the wooden board, thus assuring the stability of the nail punching effect and accurately controlling the nail punching timing. Therefore, the error caused by the loosened air source which may result in damages of the body portion or the wooden board is prevented. Further, the effect achieved by the nail gun structure are not affected by the pressure of the compressed air and the thickness of the wooden board. When the communication with the air source and the nail gun of the present invention is achieved, the nail punching operation is able to be carried out immediately, saving the procedure of adjusting the air source prior to the nail punching operation and providing a fast and convenient usage.

Also, the connect member is rotatable for being applied to different operational environment, and the connection direction between the connect member and the air source is adjustable so as to prevent the operation procedure form being affected by different operation considerations. Furthermore, the block member is combined to the clamp end along the radial direction of the telescopic rod. Due to the fixing from the lateral side, the block member is able to be replaced easily, and the block member is kept facing a contact face of the punch portion, thus maintain a reliable nail punching effect.

DETAILED DESCRIPTION OF THE INVENTION

Figure 1:
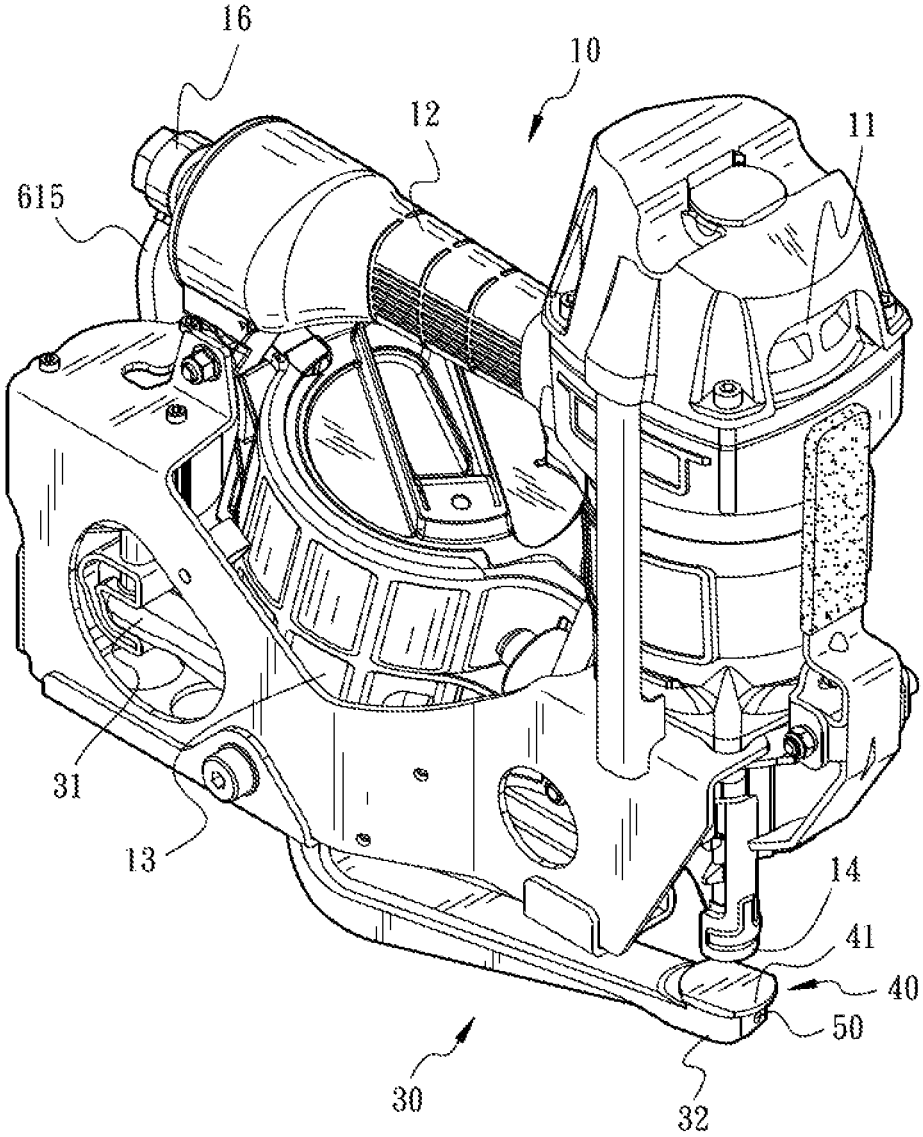
FIG. 1 is a perspective view of the nail gun structure in accordance with an embodiment of the present invention.

The aforementioned and further advantages and features of the present invention will be understood by reference to the description of the preferred embodiment in conjunction with the accompanying drawings where the components are illustrated based on a proportion for explanation but not subject to the actual component proportion.

Referring to FIG. 1 to FIG. 7, a nail gun structure in accordance with an embodiment of the present invention is provided, comprising a body portion 10, an air cylinder 20, and a control valve 60.

The body portion 10 includes a head portion 11, a handgrip 12 connected with the head portion 11 and a nail magazine 13, a punch portion 14 disposed at one end of the head portion 11, a trigger 15 disposed on one side of the head portion 11, and a connect member 16 connected between an air source and the handgrip 12. The handgrip 12 is gripped by the user. The nail magazine 13 houses a plurality of nails. A chamber is disposed between the head portion 11 and the handgrip 12, and the chamber is connected with the connect member 16. The air source provides a compressed air through the connect member 16 into the chamber, wherein the trigger 15 controls the compressed air to drive the firing pin in the nail gun to punch the nail inside the nail magazine 13, such that the nails are launched from the punch portion 14.

Also, in an embodiment of the present invention, the connect member 16 is able to rotate with the rotation axis thereof arranged along a radial direction of the head portion 11. Therefore, when the environmental space on two sides are relative narrow, the connection portion between the connect member 16 and the air source is allowed to be rotate toward upside or downside, such that the operation procedure is not affected by the environmental consideration limitations.

The air cylinder 20 is disposed between the body portion 10 and the clamp arm 30. The air cylinder 20 is provided with an air chamber 22 and a telescopic rod 21 having one end thereof pivotally connected with the clamp arm 30 and the other end thereof disposed inside the air chamber 22. Besides, the air cylinder 20 is provided with a piston 23, a first bore 24, and a second bore 25, wherein the first bore 24 and the second bore 25 are mutually spaced and disposed along an axial direction of the telescopic rod 21. In an embodiment of the present invention, the distance between the second bore 25 and the clamp arm 30 is smaller than the distance between the first bore 24 and the clamp arm 30, and the piston 23 is connected with one end of the telescopic rod 21. When the piston 23 reciprocates along the axial direction of the telescopic rod 21, the telescopic rod 21 drives the clamp arm 30 to operate, such that the clamp arm 30 sways against the punch portion 14. At the same time, the piston 23 moves to control the communication between the second bore 25 and the air chamber 22. When the piston 23 moves from the first bore 24 toward the second bore 25, the clamp arm 30 sways toward the punch portion 14; when the piston 23 moves from the second bore 25 toward the first bore 24, the clamp arm 30 sways away from the punch portion 14.

Further, the clamp arm 30 is provided with a connect end 31 and a clamp end 32 disposed in opposite to the connect end 31. The connect end 31 is connected with one end of the telescopic rod 21, and the clamp end 32 faces the punch portion 14, such that a wooden board 1 is able to be placed between the clamp end 32 and the punch portion 14. Also, the clamp end 32 is provided with a block member 40, which is combined to the clamp end 32 along the radial direction of the telescopic rod 21. The block member 40 prevents the clamp end 32 from being damaged when the nail is launched. In an embodiment of the present invention, a fix member 50 is applied to fix the block member 40 to the clamp end 32 along the radial direction of the telescopic rod 21. Therefore the block member 40 is screwed from a lateral side thereof and is facilitated to be replaced with a new one. Also, the screwing position of the fix member 50 prevents the contact face 41 of the block member 40 corresponding to the punch portion 14 from being affected by the fix member 50 and subsequently impose negative effect upon the nail punching effect. The fix member 50 is allowed to be a screw, a bolt, or an engage member.

The control valve 60 is disposed between the air cylinder 20 and the body portion 10. The control valve 60 is provided with a tube set 61 connected between the air cylinder 20 and the body portion 10, and the tube set 61 is further connected with the air source, while the air source provided a compressed air to the tube set 61. When the air source and the tube set 61 communicate with the first bore 24, the piston 23 moves to conduct the communication of the second bore 25, such that the telescopic rod 21 drives the clamp arm 30 to sway against the punch portion. When the clamp arm 30 and the punch portion 14 are driven to clamp the wooden board 1, the second bore 25 and the tube set 61 are made communicate with the body portion 10, and the punch portion 14 launches the nail.

The control valve 60 includes a first valve chamber 62 and a second valve chamber 63 that are connected with the body portion 10 and the air cylinder 20. The tube set 61 includes a first tube 611, a second tube 612, a third tube 613, a fourth tube 614, and a fifth tube 615. The first tube 611 and the second tube 612 are connected with the first valve chamber 62, and the first tube 611 is further connected with the air source. The second tube 612 is connected with the first bore 24. The third tube 613 and the fourth tube 614 are connected with the second valve chamber 63. The fourth tube 614 is further connected with the air source. The third tube 613 is further connected with the second bore 25. The fifth tube 615 is connected with the air source, the first valve chamber 62, and the second valve chamber 63. The trigger 15 controls the air input and air discharge function of the first tube 611. When the trigger 15 is pulled to drive the first tube 611 to discharge air, the second tube 612 communicates with the first bore 24, such that the piston 23 moves to conduct the communication function of the second bore 25. When the trigger 15 is not pulled and the air is input through the first tube 611, the second tube 612 does not communicate with the first valve chamber 62.

Figure 3:
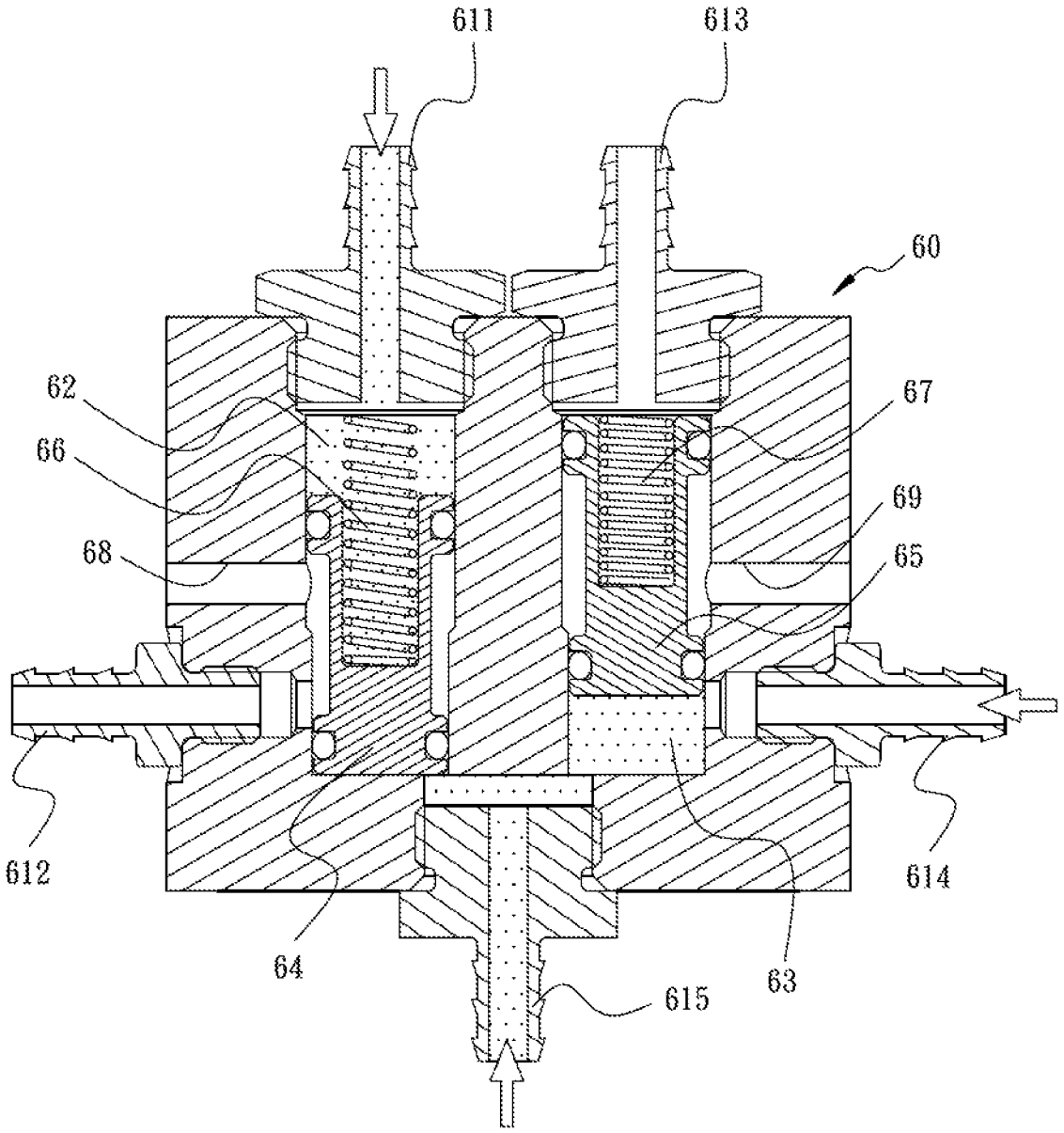
FIG. 3 is a schematic view illustrating the operation status of the control valve, wherein the trigger is not pulled.
Figure 4:
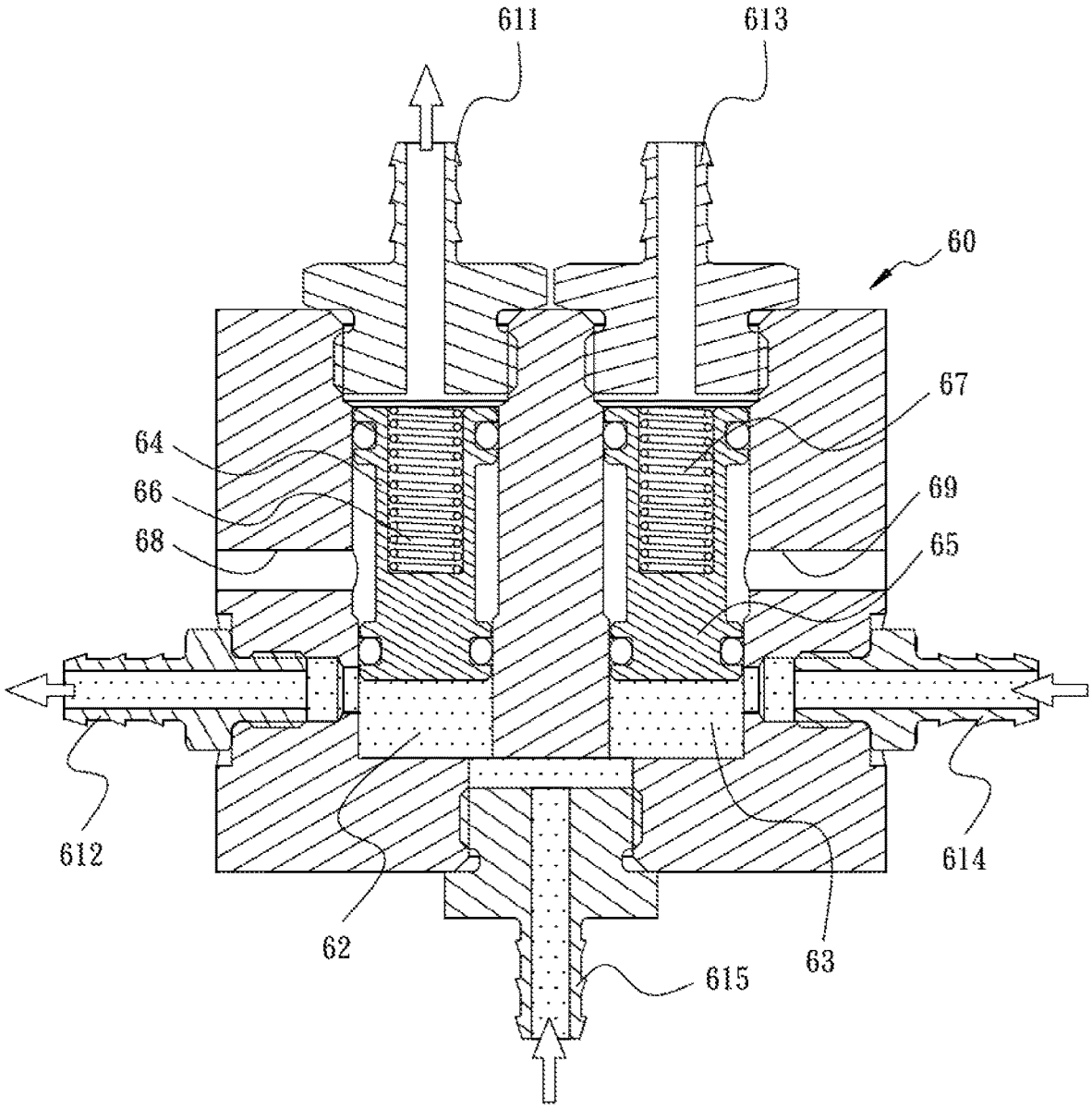
FIG. 4 is a schematic view illustrating the operation status of the control valve, wherein the trigger is pulled, such that the first valve chamber and the second valve chamber mutually communicate.

The control valve 60 is further provided with a first valve rod 64, a second valve rod 65, a first spring 66, and a second spring 67. The first spring 66 is disposed in the first valve chamber 62 and resists against the first valve rod 64; the second spring 67 is disposed in the second valve chamber 63 and resists against the second valve rod 65. In an embodiment of the present invention, as shown by FIG. 1 and FIG. 3, when the trigger 15 is not pulled, the air source continuously provided the compressed air to the first tube 611, the fourth tube 614, and the fifth tube 615, such that the first spring 66 performs an expanding status and pushes the first valve rod 64 to seal the second tube 612, while the second spring 67 performs a compressed status, such that the fourth tube 614 communicates with the second valve chamber 63. As shown by FIG. 1 and FIG. 4, when the trigger 15 is pulled, the compressed air is discharged from the first tube 611, and the compressed air inside the fifth tube 615 pushes the first valve rod 64, such that the first spring 66 performs a compressed status, and the second tube 612 communicates with the first valve chamber 62.

Furthermore, the control valve 60 includes a first vent 68 and a second vent 69. The first vent 68 is connected with the first valve chamber 62, and the second vent 69 is connected with the second valve chamber 63. When the second bore 25 communicates with the third tube 613, the fifth tube 615 does not communicate with the second valve chamber 63, while the fourth tube 614 communicates with the second vent 69, such that the compressed air is discharged from the second vent 69, wherein the punch portion 14 launch the nail toward the wooden board 1. Besides, after the punch portion 14 launch the nail toward the wooden board 1, when the trigger 15 is released to control the air input of the first tube 611, the fifth tube 615 does not communicate with the first valve chamber 62, while the second tube 612 communicates with the first vent 68, and the compressed air is discharged from the first vent 68, whereby the clamp arm 30 sways away from the punch portion 14.

Figure 2:
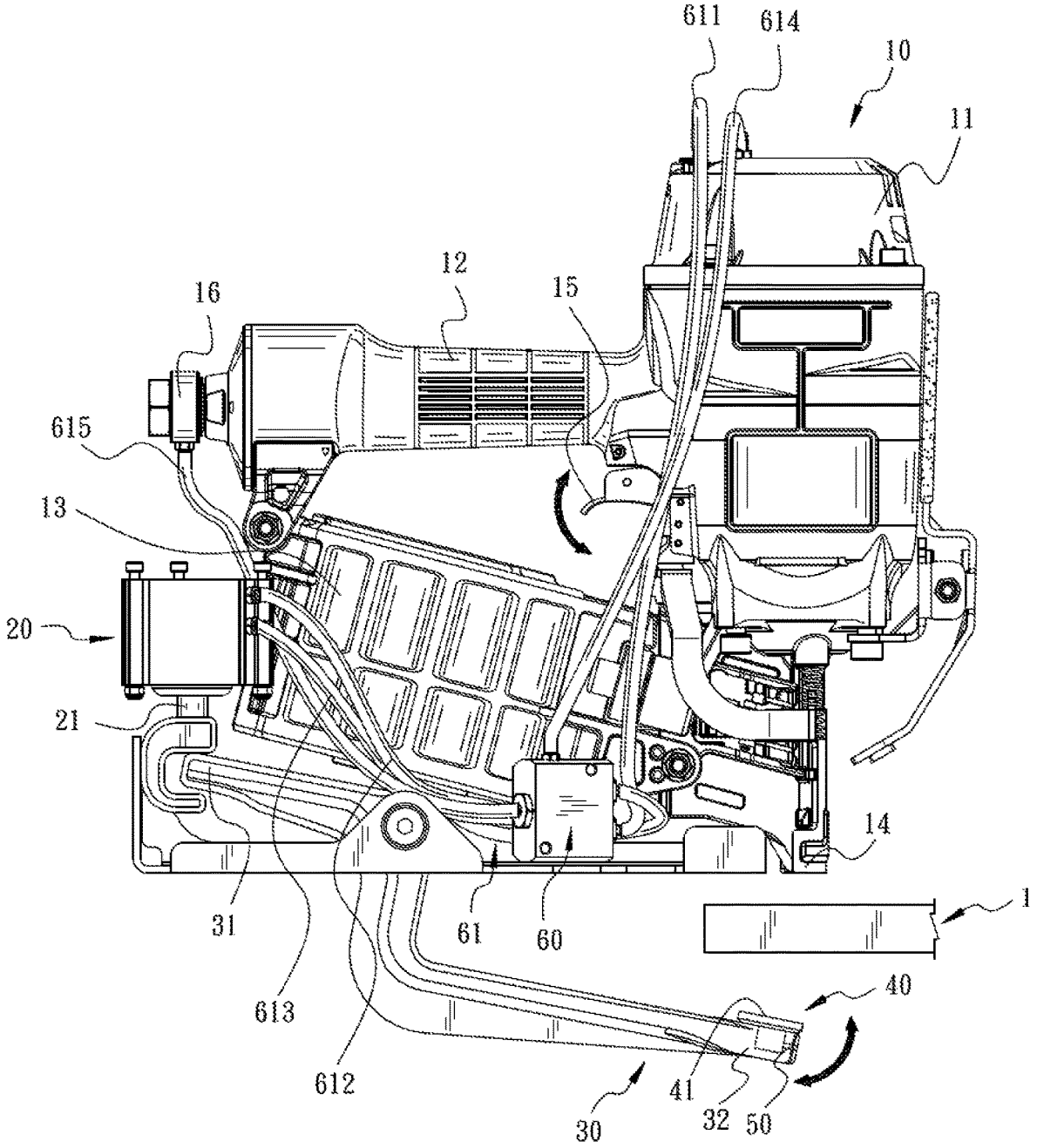
FIG. 2 is a schematic view illustrating the nail gun structure at the ready status.
Figure 5:
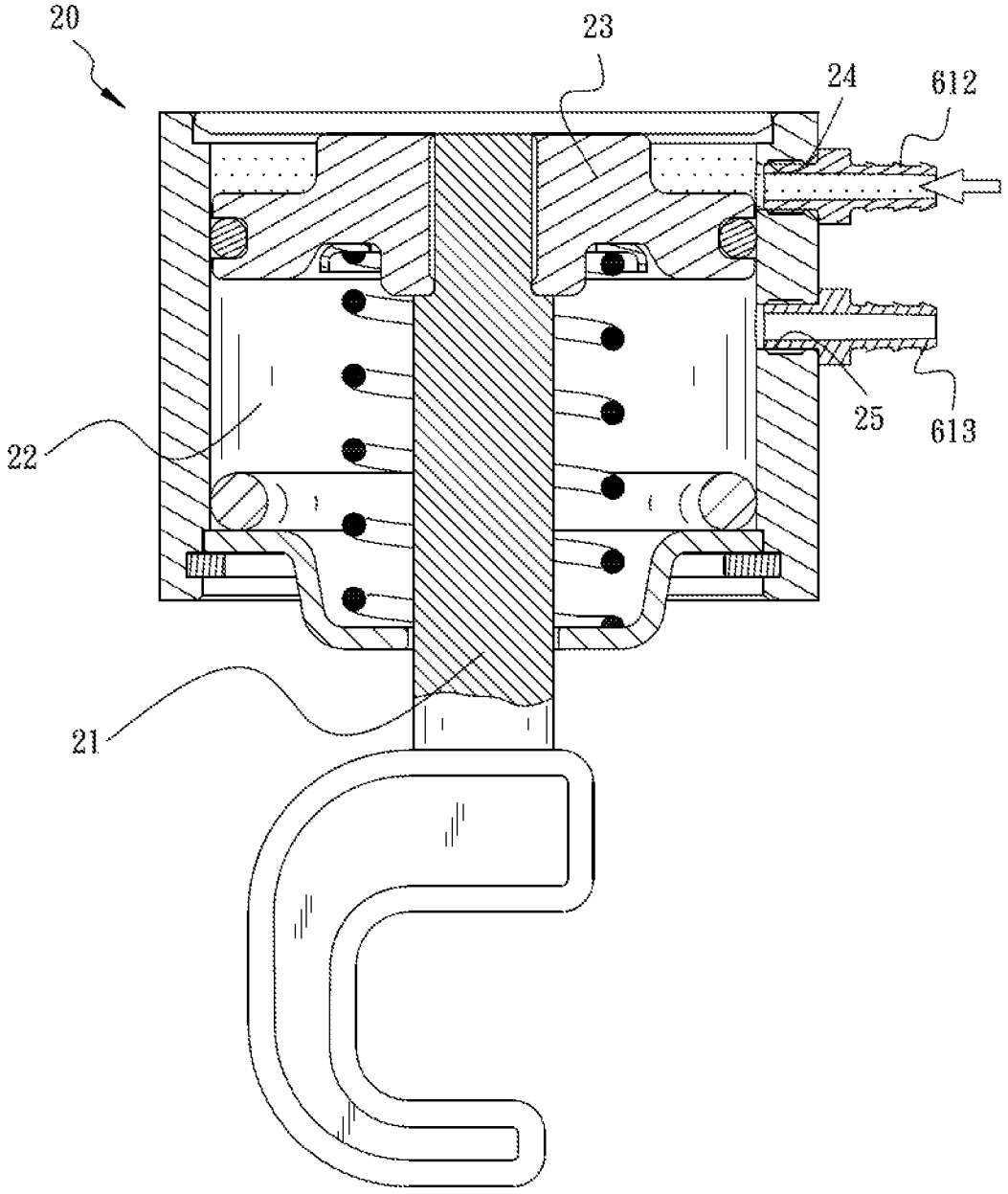
FIG. 5 is a schematic view illustrating the operation status of the air cylinder, wherein the second tube communicates with the first bore.

Referring to FIG. 1 and FIG. 3, prior to the trigger 15 being pulled to conduct the nail punching operation, the wooden board 1 is placed on the block member 40. The air source continuously provides the compressed air to the first tube 611, the fourth tube 614, and the fifth tube 615, while the second tube 612 is sealed and does not communicate with the first bore 24. Next, as shown by FIG. 2, FIG. 4, and FIG. 5, when the trigger 15 is pulled to drive the first tube 611 to discharge the air, the second tube 612 communicates with the first bore 24. When the compressed air enters the air chamber 22 from the first bore 24, the compressed air drives the piston 23 to move from the first bore 24 toward the second bore 25. Meanwhile, the piston 23 drives the telescopic rod 21 to move, and the telescopic rod 21 drives the clamp arm 30 to sway toward the punch portion 14 and clamp the wooden board 1.

Figure 6:
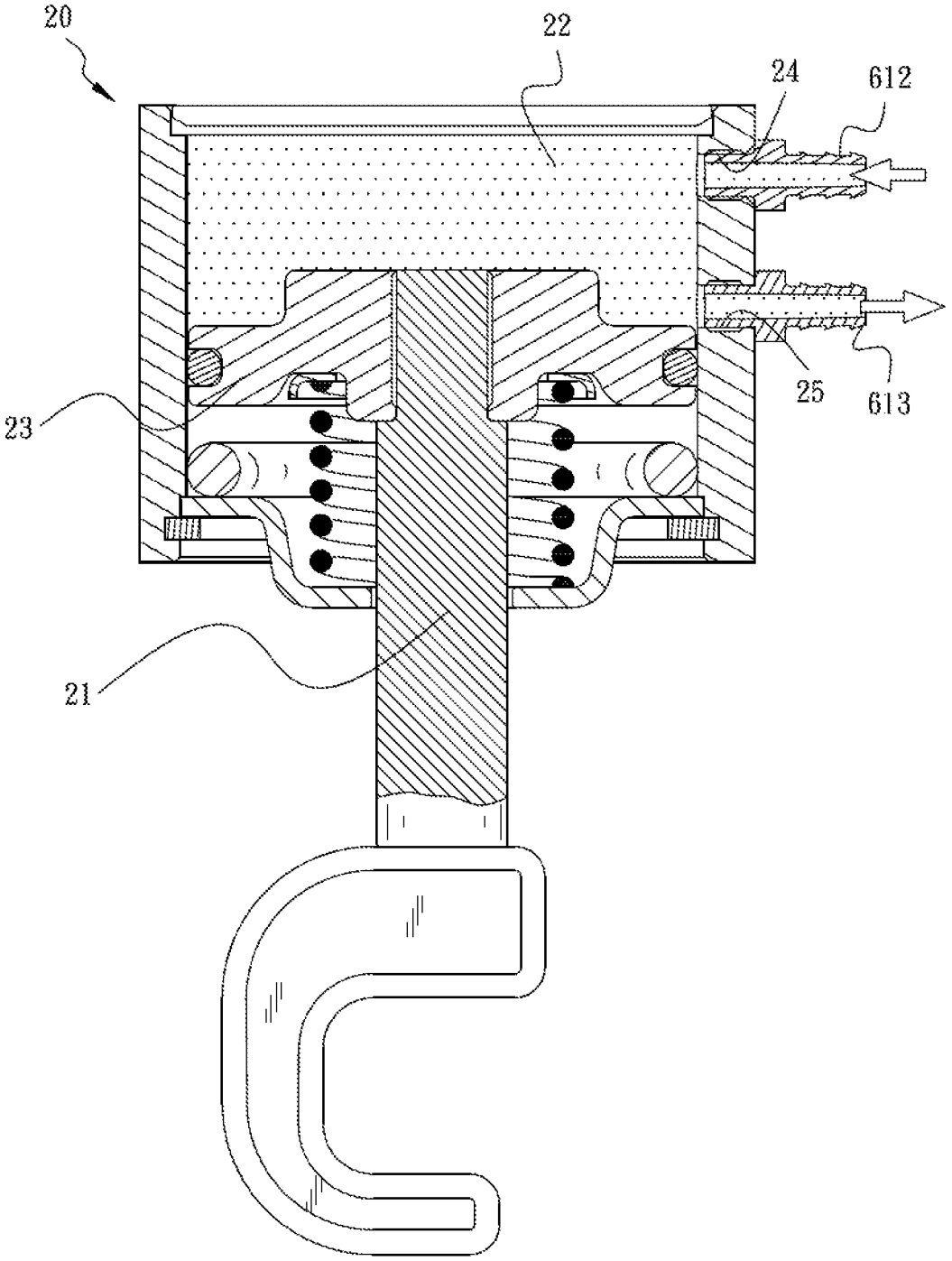
FIG. 6 is a schematic view illustrating the operation status of the air cylinder, wherein the piston moves, such that the second bore communicates with the third tube.
Figure 7:
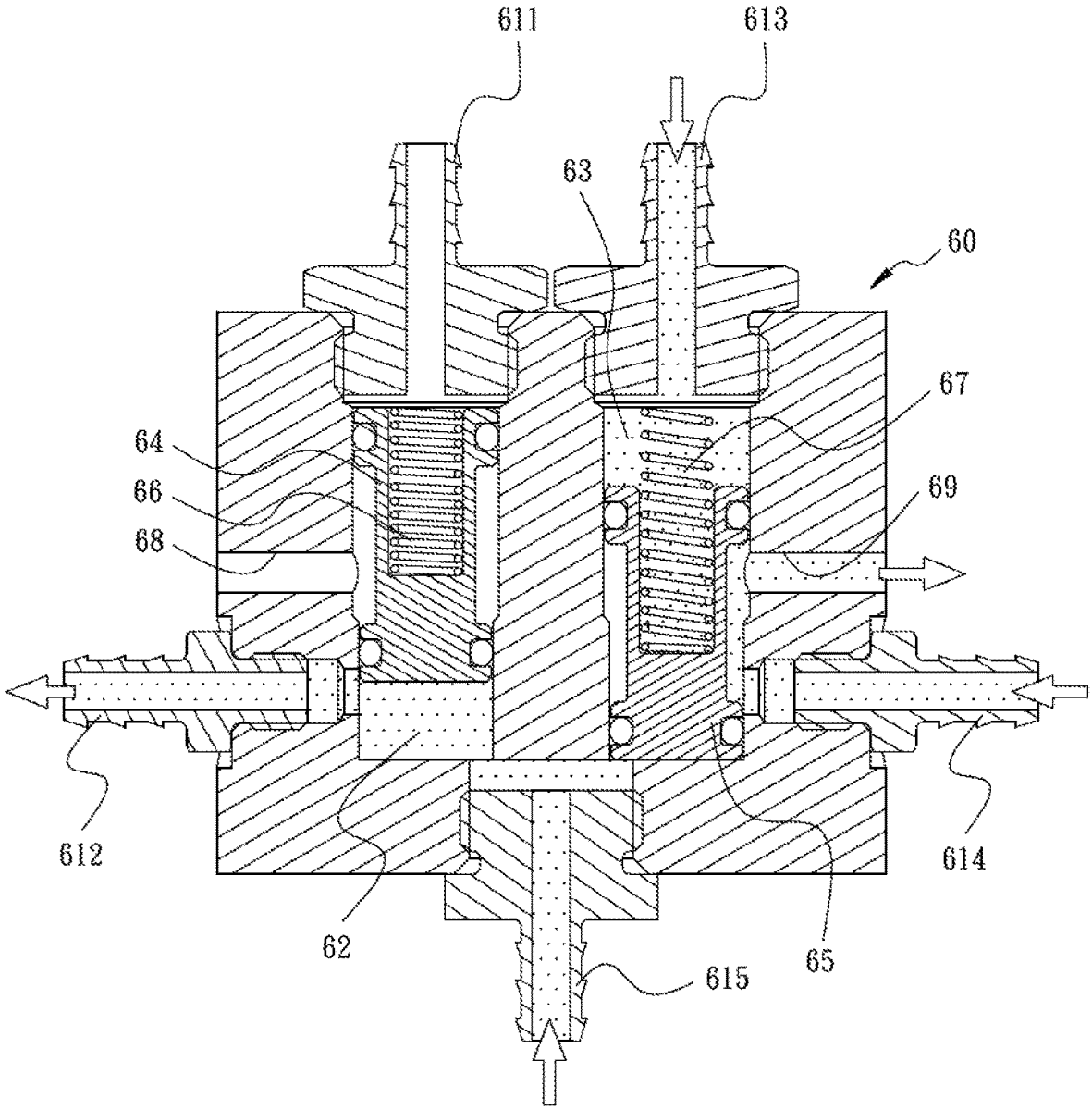
FIG. 7 is a schematic view illustrating the operation status of the air cylinder, wherein the fourth tube communicates with the second vent.

Subsequently, referring to FIG. 2, FIG. 6, and FIG. 7, when the second bore 25 communicates with the air chamber 22, the compressed air enters the third tube 613 from the second bore 25, and the compressed air pushes the second valve rod 65, such that the second spring 67 performs an expanding status, whereby the fifth tube 615 does not communicate with the second valve chamber 63, and the fourth tube 614 communicates with the second vent 69. The compressed air is discharged from the second vent 69, such that the nail inside the nail magazine 13 is punched by the firing pin to be launched from the punch portion 14 toward the wooden board 1.

When the nail punching is complete, the trigger 15 is released to re-input the air through the first tube 611, such that the fifth tube 615 does not communicate with the first valve chamber 62, and the piston 23 moves from the second bore 25 toward the first bore 24. The compressed air enters the second tube 612 from the first bore 24, and the second tube 612 communicates with the first vent 68, such that the air is discharged from the first vent 68. When the piston 23 moves, the telescopic rod 21 drives the clamp arm 30 to sway away from the punch portion 14, whereby the clamp arm 30 releases the wooden board 1. Also, when the piston 23 moves from the second bore 25 toward the first bore 24, the fifth tube 615 communicates with the second valve chamber 63 again, such that the second spring 67 performs a compressed status, whereby the firing pin inside the body portion 10 moves back to the original position, thus finishing the whole nail punching procedure.

With such configuration, during the nail punching operation of the present invention, when the first bore 24 communicates with the second tube 612, the clamp arm 30 firstly clamps the wooden board 1, with the second bore 25 communicating with the third tube 613 to conduct the nail punching operation. By deciding the nail punching timing by use of the piston 23 moving in the air cylinder 20, the nail punching operation is assured to be carried out after the clamp arm 30 stably clamping the wooden board 1. Therefore, the nail punching operation is stably carried out, with the nail punching timing accurately under controlled, thus preventing the body portion 10 and the wooden board 1 from being accidentally damaged.

Furthermore, operation of the nail gun structure is not affected by the air pressure of the compressed air and the thickness of the wooden board 1. When the connect member 16 is connected with the air source, the nail punching operation is able to be carried out. Therefore, the air source adjustment procedure before the nail punching operation is saved, facilitating a fast and convenience operational effect.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A nail gun structure, comprising:

a body portion including a punch portion, the punch portion punching a nail to launch the nail;

an air cylinder disposed between the body portion and a clamp arm, the air cylinder including a telescopic rod pivotally connected with the clamp arm, the clamp arm pivotally swaying against the punch portion, the air cylinder further including a piston, a first bore, and a second bore, the first bore and the second bore mutually spaced and disposed along an axial direction of the telescopic rod, the piston connected with the telescopic rod and reciprocating along an axial direction of the telescopic rod to control a communication function of the second bore; and a control valve disposed between the air cylinder and the body portion, the control valve including a tube set connected between the air cylinder and the body portion, with an air source connected with the tube set and providing a compressed air to the tube set; the control valve further including a first valve chamber and a second valve chamber that are connected with the air cylinder and the body portion; the tube set further including a first tube, a second tube, a third tube, a fourth tube, and a fifth tube; the first tube and the second tube connected with the first valve chamber, the first tube further connected with the air source, and the second tube further connected with the first bore; the third tube and the fourth tube connected with the second valve chamber, the third tube further connected with the second bore, and the fourth tube further connected with the air source; and the fifth tube further connected with the air source, the first valve chamber, and the second valve chamber;

wherein when the air source and the tube set communicate with the first bore, the piston moves to allow the communication of the second bore, such that the telescopic rod drives the clamp arm to sway against the punch portion, and when the clamp arm and the punch portion reaches a wooden board placed between the clamp arm and the punch portion, the second bore and the tube set communicates with the body portion, and the nail is punched from the punch portion.

2. The nail gun structure of claim 1, wherein the body portion includes a trigger controlling an air input and air discharge functions of the first tube; when the trigger controls the first tube to discharge the compressed air, the second tube communicates with the first bore, such that the piston moves to allow the communication function of the second bore.

3. The nail gun structure of claim 2, wherein the control valve includes a first vent connected with the first valve chamber; when the punch portion finishes punching and the trigger controls the first tube to input the compressed air, the fifth tube does not communicate with the first valve chamber, and the second tube communicates with the first vent, such that the compressed air is discharged from the first vent, and the clamp arm sways away from the punch portion.

4. The nail gun structure of claim 2, wherein the control valve includes a second vent connected with the second valve chamber; when the second bore communicates with the third tube, the fifth tube does not communicate with the second valve chamber, and the fourth tube communicates with the second vent, such that the compressed air is discharged from the second vent, and the punch portion punches to launch the nail toward the wooden board.

5. The nail gun structure of claim 1, wherein the body portion includes a connect member connected to and communicating with the fifth tube and the air source, and the connect member is rotatable.

6. The nail gun structure of claim 1, wherein the clamp arm includes a connect end and a clamp end disposed in opposite to the connect end, and the connect end is connected with the telescopic rod; the clamp end faces the punch portion and includes a block member, and the block member is combined to the clamp end along the radial direction of the telescopic rod.

* * * * *